US009625155B2

(12) United States Patent
Caples

(10) Patent No.: US 9,625,155 B2
(45) Date of Patent: Apr. 18, 2017

(54) COMPENSATING FOR THERMAL EXPANSION VIA CONTROLLED TUBE BUCKLING

(71) Applicant: Delavan Inc., Des Moines, IA (US)

(72) Inventor: Mark Caples, Ankeny, IA (US)

(73) Assignee: Delavan Inc., DesMoines, IA (US)

( * ) Notice: Subject to any disclaimer, the term of this patent is extended or adjusted under 35 U.S.C. 154(b) by 511 days.

(21) Appl. No.: 14/147,240

(22) Filed: Jan. 3, 2014

(65) Prior Publication Data

US 2015/0192299 A1 Jul. 9, 2015

(51) Int. Cl.
*F23R 3/28* (2006.01)

(52) U.S. Cl.
CPC .... *F23R 3/283* (2013.01); *F23R 2900/00005* (2013.01); *Y10T 29/49865* (2015.01); *Y10T 29/49945* (2015.01)

(58) Field of Classification Search
CPC ..... F23R 3/283; F23R 2900/00005; Y10T 29/49865; Y10T 29/49945
See application file for complete search history.

(56) References Cited

U.S. PATENT DOCUMENTS 5,297,391 A 3/1994 Roche
6,276,141 B1 8/2001 Pelletier
6,351,948 B1 3/2002 Goeddeke
7,900,456 B2 3/2011 Mao
8,286,433 B2 * 10/2012 Piper ..... F23R 3/14 60/739
2010/0107639 A1 * 5/2010 Myers ..... F23D 14/46 60/734

FOREIGN PATENT DOCUMENTS

EP 1813864 A2 8/2007
EP 2221542 A2 8/2010
GB 2438316 A 11/2007

OTHER PUBLICATIONS

Combined Search and Examination Report from GB Application Serial No. GB1423133.6, Dated Jun. 12, 2015, 5 pages.

* cited by examiner

*Primary Examiner* — John C Hong
(74) *Attorney, Agent, or Firm* — Kinney & Lange, P.A.

(57) ABSTRACT

One embodiment includes a fuel injector for a gas turbine engine. The fuel injector has an inlet fitting for receiving fuel. The fuel injector also has an outlet fitting for delivering fuel through a nozzle to a combustor of the gas turbine engine. An injector support extends between the inlet fitting and the outlet fitting and has an internal bore therethrough. A fuel tube extends from the inlet fitting through the internal bore of the injector support to the outlet fitting. The injector support has a greater coefficient of thermal expansion than the fuel tube. At room temperature the fuel tube is under compressive stress such that the fuel tube is buckled. As a result of differential thermal expansion of the fuel tube and the injector support during engine operation the fuel tube is relieved of compressive stress.

14 Claims, 4 Drawing Sheets

COMPENSATING FOR THERMAL EXPANSION VIA CONTROLLED TUBE BUCKLING

BACKGROUND

Fuel injectors are critical components of gas turbine engines. A fuel injector serves to convey liquid fuel from a manifold delivery system outside of the combustion zone, through a region of very hot air, and ultimately into the combustor through a nozzle. A typical fuel injector receives fuel from a manifold through an inlet fitting on one end, carries the fuel through a fuel tube disposed inside a bore of the injector support, and delivers fuel to the combustor of a gas turbine engine through an outlet fitting and nozzle on the other end. Ordinarily, the fuel tube is rigidly connected, or fixed, at both the inlet fitting and the outlet fitting.

Problems arise due to this fixed connection at both ends of the fuel tube. During engine operation, the air outside the fuel injector, to which the injector support is exposed, is in excess of 1000° F. (538° C.). The fuel tube inside of the injector support, however, is insulated by an air gap, as it must be kept below 400° F. (204° C.) to prevent fuel coking. This difference in temperature leads to differential thermal expansion of the injector support and the fuel tube. Because the fuel tube ordinarily is fixed at both ends inside the injector support, when the injector support thermally expands more than the fuel tube due to exposure to higher temperatures, the fuel tube is imparted with high stresses at the fixed connections and can fail. Therefore, the injector support must be allowed to thermally expand without causing a failure in the fuel circuit. This is especially true within modern gas turbine engines, where temperatures continue to increase.

Efforts have been made to solve this problem. Most of these efforts have centered on designing fuel tubes with coiled or helical portions, as shown for example in U.S. Pat. No. 6,276,141 to Pelletier. Another solution to compensate for differential thermal growth of the injector support and the fuel tube during engine operation has been the addition of a structure joined to the inlet end portion of the fuel tube, as shown for example in U.S. Pat. No. 7,900,456 to Mao. Although such elaborate fuel tube geometries and additional components may prevent failure in the fuel circuit due to differential thermal growth during engine operation, significant costs are incurred in making these fuel tubes.

SUMMARY

One embodiment includes a fuel injector for a gas turbine engine. The fuel injector has an inlet fitting for receiving fuel. The fuel injector also has an outlet fitting for delivering fuel through a nozzle to a combustor of the gas turbine engine. An injector support extends between the inlet fitting and the outlet fitting and has an internal bore therethrough. A fuel tube extends from the inlet fitting through the internal bore of the injector support to the outlet fitting. The injector support has a greater coefficient of thermal expansion than the fuel tube. At room temperature the fuel tube is under compressive stress such that the fuel tube is buckled. As a result of differential thermal expansion of the fuel tube and the injector support during engine operation the fuel tube is relieved of compressive stress.

Another embodiment includes a method to allow for thermal expansion of a fuel injector during engine operation without causing a failure in the fuel circuit. A fuel tube which extends from an inlet fitting through an internal bore of an injector support to an outlet fitting is fixed at a first end at one of the inlet fitting or the outlet fitting, such that the fuel tube is constrained at the first end and free to slide in a joint at a second end. The injector support has a greater coefficient of thermal expansion than the fuel tube. The fuel injector is heated to an elevated temperature to cause differential thermal expansion such that the injector support expands more than the fuel tube. The second end of the fuel tube is fixed at the other of the inlet fitting and the outlet fitting while the fuel injector is at the elevated temperature. The fuel injector is cooled to room temperature such that the injector support contracts more than the fuel tube putting compressive stress on the fuel tube and causing the fuel tube to be buckled at room temperature.

DETAILED DESCRIPTION

Generally, by selecting injector support material and fuel tube material such that the injector support has a greater coefficient of thermal expansion than the fuel tube, the fuel tube can be made to buckle inside the injector support following a braze cycle during which a previously free end of the fuel tube was fixed to an inlet or outlet fitting. This buckling can be predicted and controlled such that it is not catastrophic. Then, as the injector support expands under high temperatures during engine operation, the buckling deformation provides the fuel tube with an amount of expansive capacity before it begins to be strained by expansion of the injector support. This allows for differential thermal expansion of the injector support and the fuel tube during engine operation without causing a failure in the fuel circuit, yet standard, straight fuel tubes are used and no additional structures are added to the fuel injector. Thus, cost savings are gained.

The following discussion is directed toward the use of a braze cycle to cause thermal expansion of the injector support and the fuel tube, fix the fuel tube in place at a free end while heated, and put the fuel tube under compressive stress such that the fuel tube is buckled upon cooling to room temperature. However, those skilled in the art will realize that any heating process can be used to cause thermal expansion of the injector support and fuel tube and any connection process can be used to fix the fuel tube at a free end while the fuel tube is heated and expanded. Such connection process could include, for example, welding.

Figure 1:
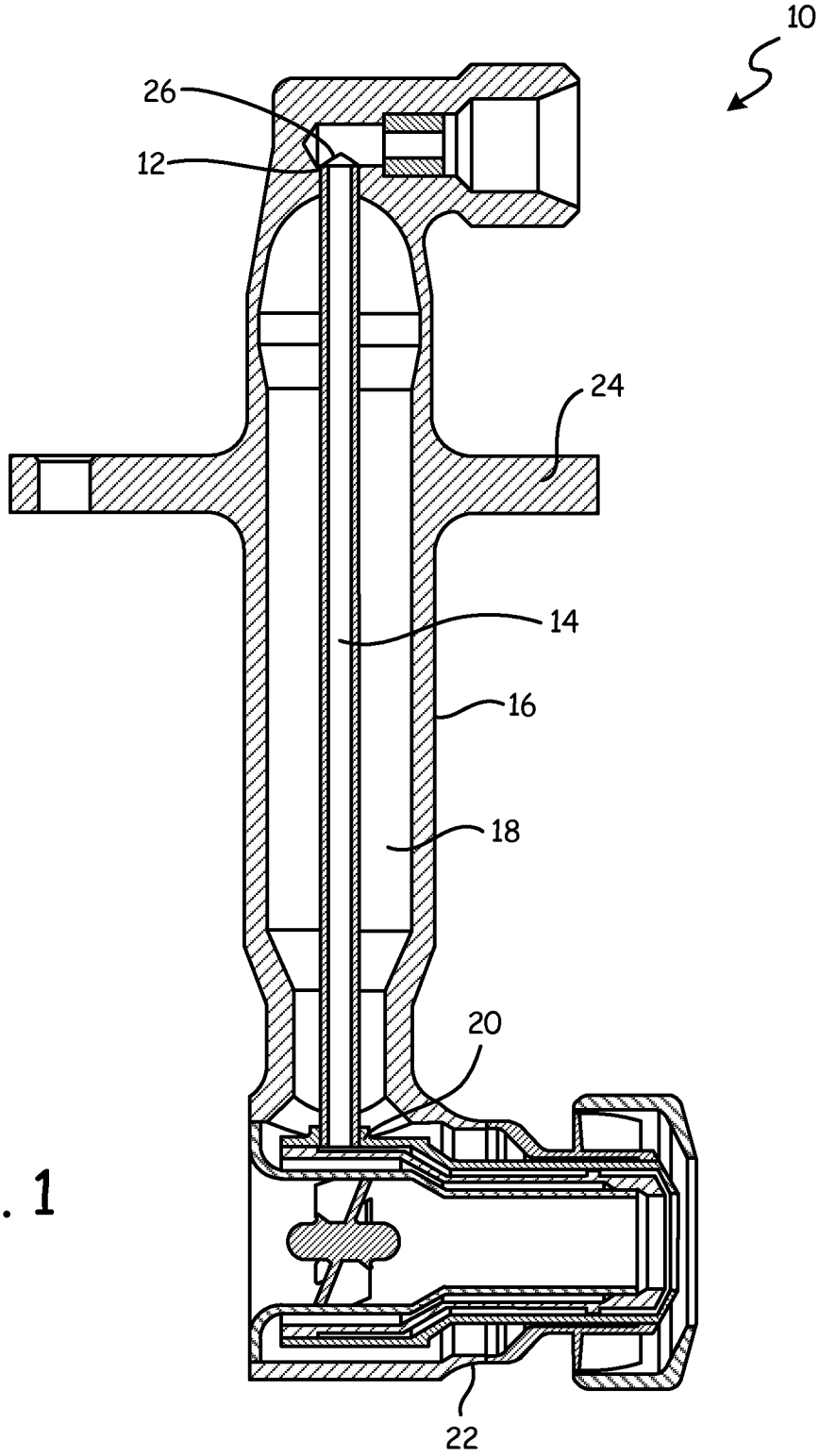
FIG. 1 shows a cross-section, side elevational view of a fuel injector assembly ready for a braze cycle where a fuel tube is fixed at an outlet fitting and free to slide at an inlet fitting.

Referring now to FIG. 1, a cross-section, side elevational view of fuel injector 10 is shown assembled and ready for a braze cycle. Fuel injector 10 has injector support 16 with a longitudinal internal bore 18 extending therethrough. Inside internal bore 18 of injector support 16 is fuel tube 14, which extends from inlet fitting 12 to outlet fitting 20. Prior to a braze cycle, fuel tube 14 is fixed at outlet fitting 20, for example by brazing or welding, and is free to slide in a joint at inlet fitting 12, such that fuel tube 14 is positioned at location 26 in inlet fitting 12. Alternatively, fuel tube 14 can be fixed at inlet fitting 12 and free to slide in a joint at outlet fitting 20. Fuel injector 10 also has support flange 24 for mounting fuel injector 10 to an outer casing of a gas turbine engine combustor (not shown), such that inlet fitting 12 is located outside of the casing and injector support 16 is located inside of the casing. Nozzle 22 of fuel injector 10 delivers fuel from fuel tube 14 at outlet fitting 20 into the combustor of a gas turbine engine.

It is required that injector support 16 and fuel tube 14 be made of materials such that injector support 16 has a greater coefficient of thermal expansion than fuel tube 14. For example, injector support 16 can be made of 300 series stainless steel and fuel tube 14 can be made of Inconel® 625 alloy. Specifically, injector support 16 made of 347 stainless steel will have a coefficient of thermal expansion of $11.1\times10^{-6}$ in/in ° F. ($19.98\times10^{-6}$ cm/cm ° C.) and fuel tube 14 made of Inconel® 625 alloy will have a coefficient of thermal expansion of $9.1\times10^{-6}$ in/in ° F. ($16.38\times10^{-6}$ cm/cm ° C.). If injector support 16 is made of 300 series stainless steel, fuel tube 14 can also, for example, be made of Hastelloy® X alloy, or 400 series stainless steel. However, the specific materials discussed here are exemplary. Injector support 16 and fuel tube 14 can be made of any materials that are capable of withstanding the applicable high temperatures, so long as the material used for injector support 16 has a greater coefficient of thermal expansion than the material used for fuel tube 14.

Figure 2A:
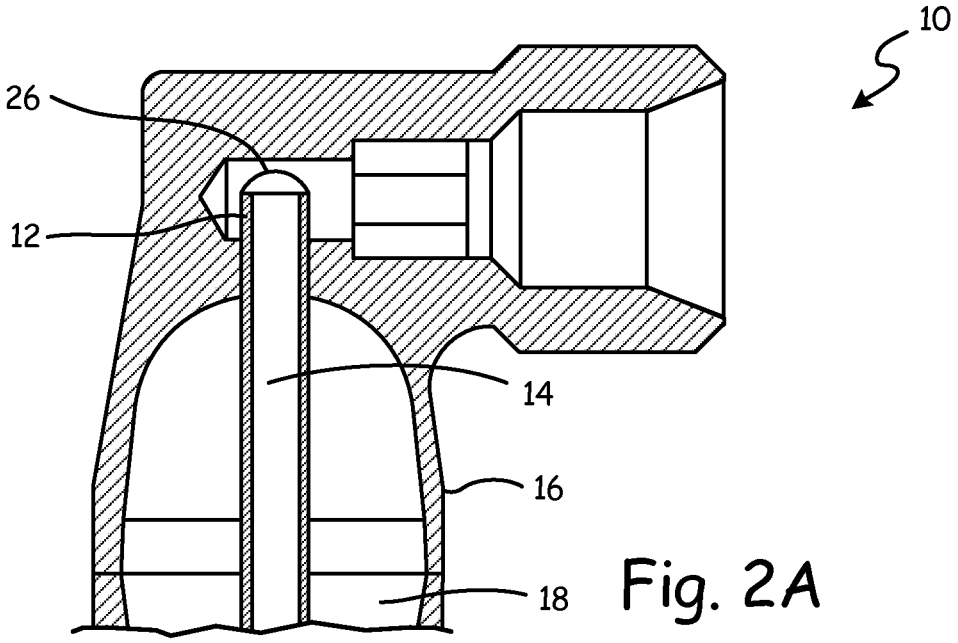
FIG. 2A shows a cross-section, side elevational close-up view of the inlet fitting of FIG. 1 where the fuel tube is free to slide in a joint of the inlet fitting prior to a braze cycle.

FIG. 2A shows a cross-section, side elevational close-up view of inlet fitting 12 of fuel injector 10 of FIG. 1 where fuel tube 14 is free to slide in a joint at inlet fitting 12 prior to a braze cycle. As was shown in and discussed for FIG. 1, fuel tube 14 is fixed at its other end to outlet fitting 20. Before a braze cycle, fuel tube 14 is positioned in inlet fitting 12 at location 26. Also present is internal bore 18 of injector support 16. Once fuel injector 10 is assembled as shown in FIG. 1 and FIG. 2A, fuel injector 10 is ready for a braze cycle.

Figure 2B:
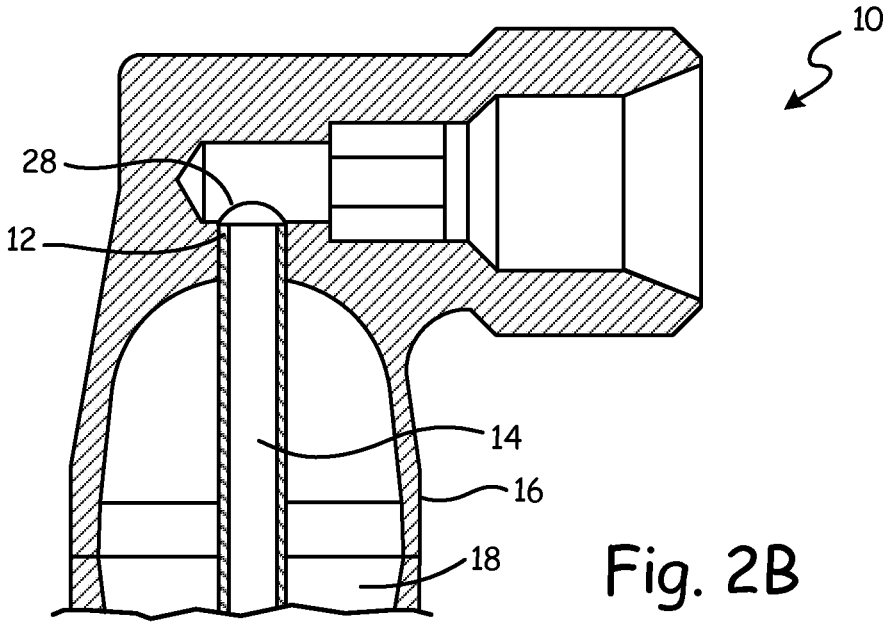
FIG. 2B shows a cross-section, side elevational close-up view of the inlet fitting of FIG. 1 where the fuel tube is fixed at the inlet fitting during a braze cycle.

FIG. 2B shows a cross-section, side elevational close-up view of inlet fitting 12 of fuel injector 10 of FIG. 1 during a braze cycle. During a typical braze cycle the entire fuel injector 10 is heated to approximately 1870° F. (1021° C.). Because injector support 16 has a greater coefficient of thermal expansion than fuel tube 14, injector support 16 will expand more than fuel tube 14, which is fixed at its other end in internal bore 18 to outlet fitting 20 (shown in FIG. 1). The fixed connection of fuel tube 14 at outlet fitting 20 causes fuel tube 14 to move further out from inlet fitting 12, even though fuel tube 14 expands itself, due to the greater expansion of injector support 16. This results in fuel tube 14 now being positioned in a joint of inlet fitting 12 at location 28. Specifically, the difference in distance between location 26 of FIG. 2A and location 28 of FIG. 2B is the difference in thermal expansion of injector support 16 and fuel tube 14. At this point, liquid braze alloy flows into the joint at inlet fitting 12. During cool down, the braze alloy solidifies at approximately 1740° F. (949° C.), at which time fuel tube 14 is locked into the joint of inlet fitting 12 at location 28.

The thermal expansion of injector support 16 and fuel tube 14 during the braze cycle can each be predicted using the equation $\delta=1*\delta t*\alpha$, where $\delta 1$ is the change in length in inches (cm), 1 is the original length in inches (cm), $\delta t$ is the change in temperature from room temperature in degrees Fahrenheit (Celsius), and $\alpha$ is the coefficient of thermal expansion of the material in inches/inch degrees Fahrenheit (cm/cm degrees Celsius). Here, fuel tube 14 is six inches (15.24 cm) in length and made of Inconel® 625. Therefore, the change in length of fuel tube 14 due to expansion during the braze cycle is 6 in.*(1740° F.−70° F.)*$9.1\times10^{-6}$ in./in. ° F.=0.0912 inch (15.24 cm*(949° C.−21.1° C.)*$16.38\times10^{-6}$ cm/cm ° C.=0.2316 cm). Similarly, injector support 16 is six inches (15.24 cm) in length and made of 347 stainless steel, thus the change in length of injector support 16 due to expansion during the braze cycle is 6 in.*(1740° F.−70° F.)*$11.1\times10^{-6}$ in./in. ° F.=0.1112 inch (15.24 cm*(949° C.−21.1° C.)*$19.98\times10^{-6}$ cm/cm ° C.=0.2824 cm). Therefore, the difference in thermal expansion of injector support 16 and fuel tube 14 here is 0.02 inch (0.05 cm).

As fuel injector 10 continues to cool, all components will return to their original sizes. However, because injector support 16 has expanded 0.02 inch (0.05 cm) more than fuel tube 14, injector support 16 will contract 0.02 inch (0.05 cm) more than fuel tube 14. Due to fuel tube 14 now being fixed at both ends—inlet fitting 12 and outlet fitting 20—fuel tube 14 is forced to contract with injector support 16 an extra 0.02 inch (0.05 cm) than fuel tube 14 had expanded, putting fuel tube 14 under compressive stress causing fuel tube 14 to be buckled at room temperature. For fuel tube 14 to buckle under the compressive stress induced by the extra contraction of injector support 16, fuel tube 14 must have a high slenderness ratio. The slenderness ratio is a ratio between the length of the fuel tube and the outside diameter of the fuel tube. High slenderness ratios, of approximately 90 or greater, are preferred for buckling of fuel tube 14. In this embodiment, fuel tube 14 has a slenderness ratio of approximately 108. However, if fuel tube 14 does not have a high slenderness ratio then fuel tube 14 will fail by direct compression before it buckles, leaving fuel tube 14 unfit for use during engine operation.

Figure 3:
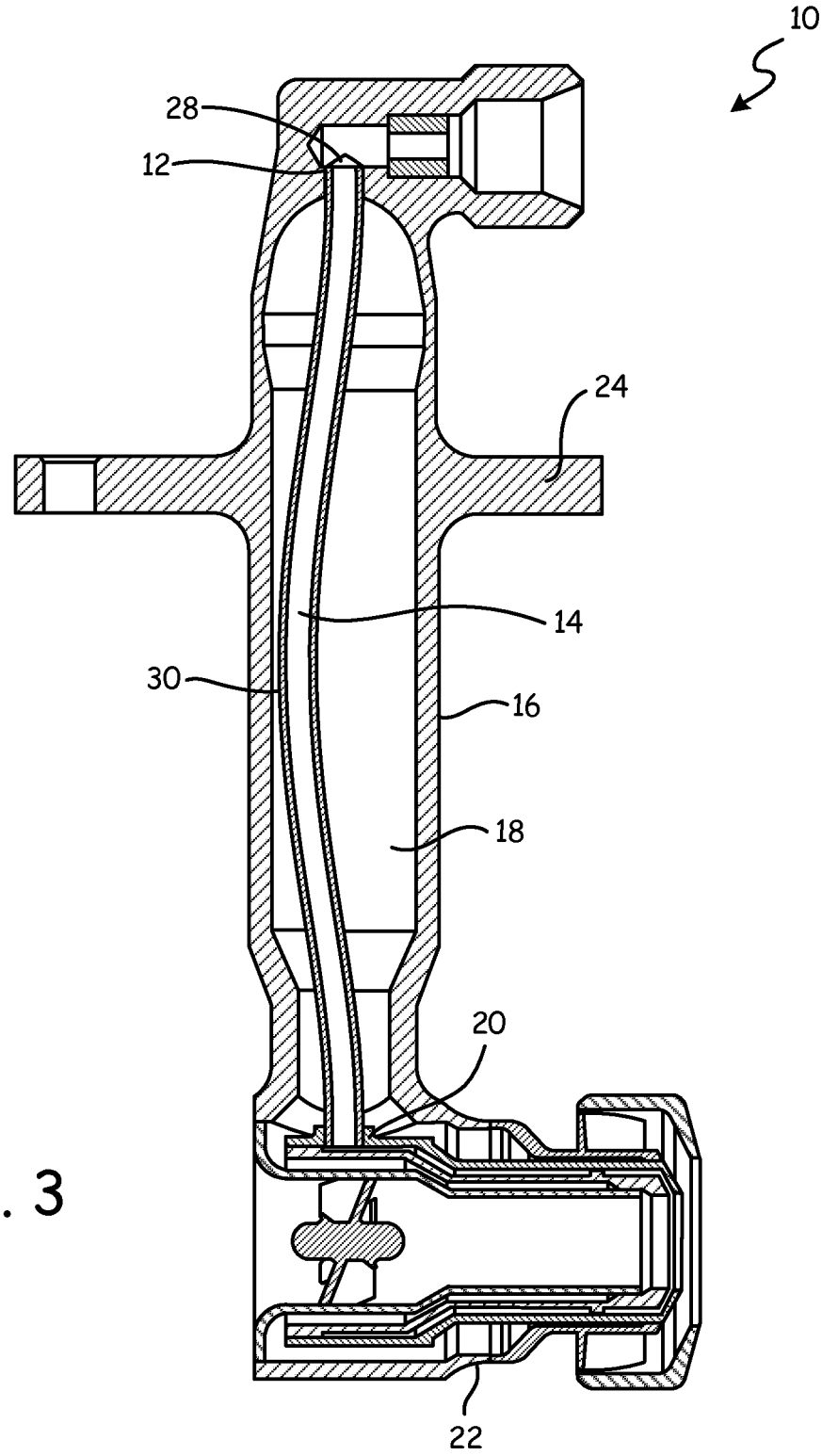
FIG. 3 shows a cross-section, side elevational view of a fuel injector assembly at room temperature, after a braze cycle, where the fuel tube is under compressive stress such that the fuel tube is buckled.

FIG. 3 shows a cross-section, side elevational view of fuel injector 10 upon cooling to room temperature after a braze cycle where fuel tube 14 is under compressive stress such that fuel tube 14 is buckled, as indicated at 30. By design, the buckling occurs at a relatively low compressive force, and therefore, results in lower stresses than would otherwise be sustained by fuel tube 14. Fuel injector 10 is mounted to an outer casing of a gas turbine engine combustor (not shown) using support flange 24, such that inlet fitting 12 is located outside of the casing and injector support 16 is located inside of the casing. Fuel is supplied from a fuel manifold (not shown) to inlet fitting 12. This fuel enters fuel tube 14, which is fixed to inlet fitting 12 such that fuel tube 14 is within a joint of inlet fitting 12 at location 28. Fuel is then carried in fuel tube 14 through internal bore 18 of injector support 16 to outlet fitting 20, where fuel tube 14 is also fixed. Finally, fuel is delivered from outlet fitting 20 to nozzle 22, which then sprays fuel in the combustor of the gas turbine engine.

Fuel injector 10 shown in FIG. 3 allows for thermal expansion of injector support 16 during engine operation without causing a failure in the fuel circuit. During engine operation injector support 16 is exposed to significantly higher temperatures than fuel tube 14, and consequently, injector support 16 will expand more than fuel tube 14. As injector support 16 expands, the buckling deformation provides fuel tube 14 with an amount of expansive capacity before fuel tube 14 begins to be strained. Thus, the initial differential thermal growth of injector support 16 goes into relieving the compressive stress present in fuel tube 14, thus reducing the total strain placed on fuel tube 14. When this occurs fuel tube 14 moves back to its location prior to the braze cycle, extending straight between inlet fitting 12 and outlet fitting 20. The controlled buckling of fuel tube 14 that takes place as a result of the braze cycle, does not induce permanent deformation in fuel tube 14.

Specifically, in this embodiment the first 0.02 inch (0.05 cm) (the difference in thermal expansion of injector support 16 and fuel tube 14 calculated for FIG. 2B) of differential thermal expansion of injector support 16 occurs without placing any strain on fuel tube 14 or the brazed joints at inlet fitting 12 and outlet fitting 20. Rather, the first 0.02 inch (0.05 cm) of differential thermal expansion of injector support 16 goes into relieving compressive stress present in fuel tube 14 as a result of the braze cycle. Fuel tube 14 only begins to experience strain if and when injector support 16 expands beyond 0.02 inch (0.05 cm) greater than fuel tube 14. During engine operation, injector support 16 will be approximately 1100° F. (593.3° C.) and fuel tube 14 will be approximately 400° F. (204.4° C.), creating a tensile stress in fuel tube 14 of 42 ksi (289.6 MPa). This tensile stress is well below the yield strength of 60 ksi (413.7 MPa) of fuel tube 14 made of Inconel® 625.

Figure 4:
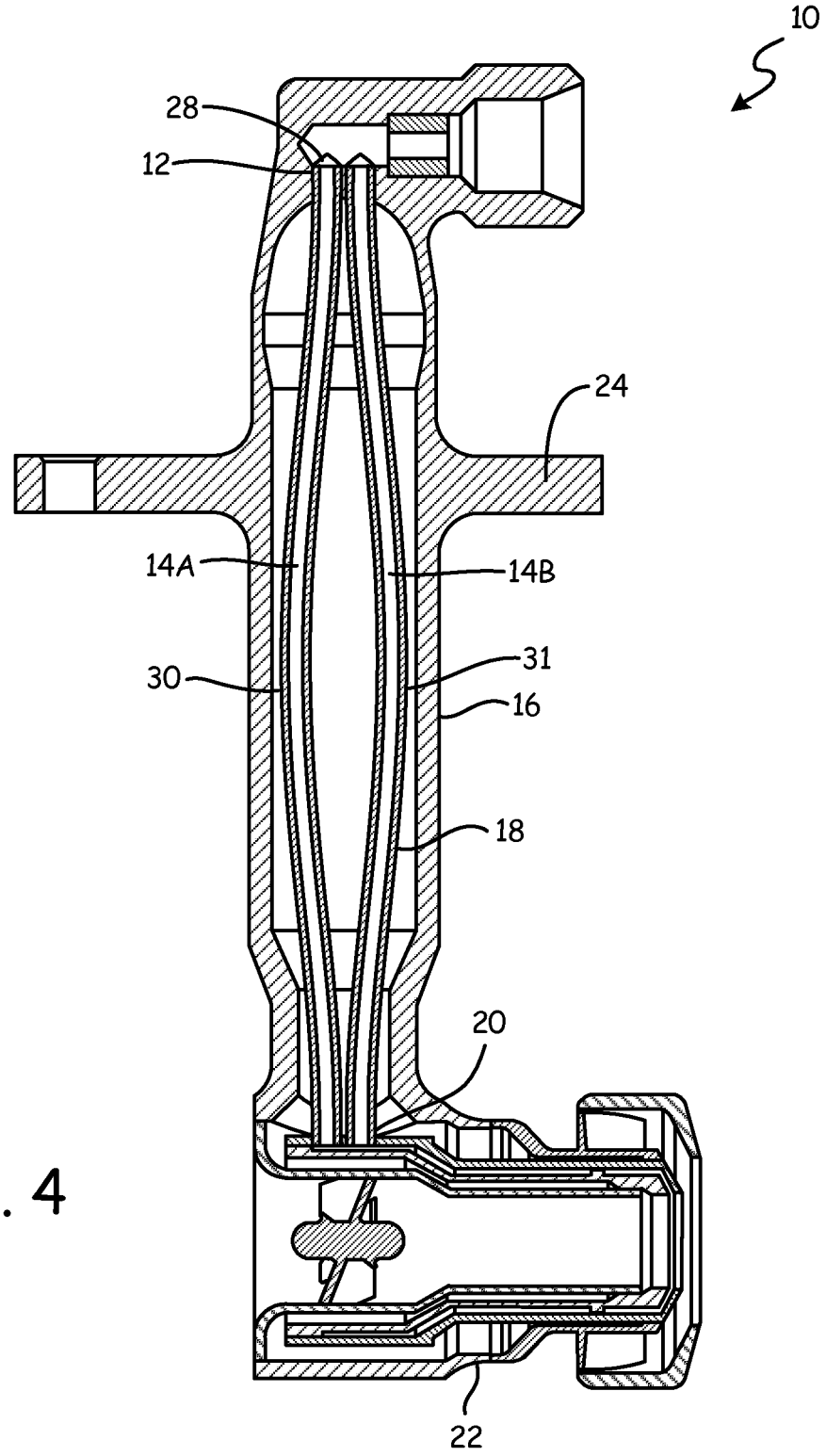
FIG. 4 shows a cross-section, side elevational view of a fuel injector assembly at room temperature with two fuel tubes, after a braze cycle, where each fuel tube is under compressive stress such that each fuel tube is buckled.

FIG. 4 shows a cross-section, side elevational view of an embodiment of fuel injector 10 upon cooling to room temperature after a braze cycle where two fuel tubes are present—fuel tube 14A and fuel tube 14B. In this embodiment, fuel tubes 14A and 14B must be assembled prior to the braze cycle to extend parallel to each other from inlet fitting 12 to outlet fitting 20 inside of internal bore 18 of injector support 16. This means fuel tubes 14A and 14B do not overlap at any point between inlet fitting 12 and outlet fitting 20. If fuel tubes 14A and 14B do not run parallel to each other, this can constrain fuel tubes 14A and 14B and prevent the controlled buckling from occurring.

Fuel injector 10 is subjected to a braze cycle in the same manner as that detailed previously. Fuel tubes 14A and 14B are again locked in place at location 28 in a joint at inlet fitting 12 during the braze cycle. Then, fuel tubes 14A and 14B each are put under compressive stress and buckle, as indicated at locations 30 and 31 respectively, at room temperature. Again, injector support 16 is made of a material such that the coefficient of thermal expansion of injector support 16 is higher than the coefficient of thermal expansion of fuel tubes 14A and 14B.

Multiple fuel tubes 14A and 14B can be utilized when a larger fuel carrying capacity is needed. As discussed previously for FIG. 2B, fuel tubes 14A and 14B must have a high slenderness ratio. For this reason, it is undesirable to use a single, larger fuel tube instead of multiple fuel tubes 14A and 14B because the single fuel tube would have a low slenderness ratio resulting in the single fuel tube failing by direct compression before it buckles, leaving the single fuel tube unfit for use during engine operation.

When discussing 300 series stainless steel, it is intended that this refer to stainless steels with the following approximate chemical composition by weight: 0.25% maximum carbon; 2% maximum manganese; 0.045% maximum phosphorus; 0.03% maximum sulfur; 1.5% maximum silicon; 16-26% chromium; 8-22% nickel; and 4% maximum molybdenum. When discussing 400 series stainless steel, it is intended that this refer to stainless steels with the following approximate chemical composition by weight: 1.2% maximum carbon; 1.25% maximum manganese; 0.06% maximum phosphorus; 0.03% maximum sulfur; 0.06% maximum nitrogen; 1% maximum silicone; 11.5-18% chromium; 0.55% maximum nickel; and 0.75% maximum molybdenum. When discussing Inconel® 625, it is intended that this refer to the following approximate chemical composition by weight: niobium plus tantalum 3.15-4.15%; 5% maximum iron; 8-10% molybdenum; 20-23% chromium; 58% minimum nickel. When discussing Hastelloy® X, it is intended that this refer to the following approximate chemical composition by weight: 22% chromium; 18% iron; 9% molybdenum; 1.5% cobalt; 0.6% tungsten; 0.1% carbon; 1% maximum manganese; 1% maximum silicone; 0.008% maximum boron; and the balance, around 47%, nickel. All of the chemical compositions stated above can include incidental impurities.

Discussion of Possible Embodiments

The following are non-exclusive descriptions of possible embodiments of the present invention.

A fuel injector for a gas turbine engine, the fuel injector comprising an inlet fitting for receiving fuel, an outlet fitting for delivering fuel through a nozzle to a combustor of the gas turbine engine, an injector support extending between the inlet fitting and the outlet fitting having an internal bore therethrough, and a fuel tube extending from the inlet fitting through the internal bore of the injector support to the outlet fitting; wherein the injector support has a greater coefficient of thermal expansion than the fuel tube. At room temperature the fuel tube is under compressive stress such that the fuel tube is buckled, and wherein as a result of differential thermal expansion of the fuel tube and the injector support during engine operation the fuel tube is relieved of compressive stress.

The fuel injector of the preceding paragraph can optionally include, additionally and/or alternatively, any one or more of the following features, configurations and/or additional components:

A further embodiment of the foregoing fuel injector, wherein the fuel tube is initially imparted with compressive stress and buckles during a braze cycle.

A further embodiment of the foregoing fuel injector, wherein the fuel tube has a high slenderness ratio.

A further embodiment of the foregoing fuel injector, wherein the fuel tube has a slenderness ratio of 90 or greater.

A further embodiment of the foregoing fuel injector, wherein the injector support is made of 300 series stainless steel.

A further embodiment of the foregoing fuel injector, wherein the fuel tube is made of Inconel 625.

A further embodiment of the foregoing fuel injector, wherein the fuel tube is made of Hastelloy X.

A further embodiment of the foregoing fuel injector, wherein the fuel tube is made of 400 series stainless steel.

A further embodiment of the foregoing fuel injector, further comprising multiple fuel tubes extending from the inlet fitting through the internal bore of the injector support to the outlet fitting.

A method to allow for thermal expansion of a fuel injector during engine operation without causing a failure in a fuel circuit, the method comprising fixing a first end of a fuel tube which extends from an inlet fitting through an internal bore of an injector support to an outlet fitting at one of the inlet fitting or the outlet fitting, such that the fuel tube is constrained at the first end and free to slide in a joint at a second end, and wherein the injector support has a greater coefficient of thermal expansion than the fuel tube; heating the fuel injector to an elevated temperature to cause differential thermal expansion such that the injector support expands more than the fuel tube; fixing the second end of the fuel tube at the other of the inlet fitting and the outlet fitting while the fuel injector is at the elevated temperature; and cooling the fuel injector to room temperature such that the injector support contracts more than the fuel tube putting compressive stress on the fuel tube and causing the fuel tube to be buckled at room temperature.

The method of the preceding paragraph can optionally include, additionally and/or alternatively, the following techniques, steps, features and/or configurations:

A further embodiment of the foregoing method, wherein the heating and fixing are performed during a braze cycle.

A further embodiment of the foregoing method, wherein the fuel tube has a slenderness ratio of 90 or greater.

A further embodiment of the foregoing method, wherein the injector support is made of 300 series stainless steel.

A further embodiment of the foregoing method, wherein the fuel tube is made of 400 series stainless steel.

A further embodiment of the foregoing method, wherein the fuel tube is made of Inconel 625 or Hastelloy X.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fuel injector for a gas turbine engine, the fuel injector comprising:

an inlet fitting for receiving fuel;

an outlet fitting for delivering fuel through a nozzle to a combustor of the gas turbine engine;

an injector support extending between the inlet fitting and the outlet fitting having an internal bore therethrough; and a fuel tube extending from the inlet fitting through the internal bore of the injector support to the outlet fitting; wherein the injector support has a greater coefficient of thermal expansion than the fuel tube, and wherein at room temperature the fuel tube is under compressive stress such that the fuel tube is buckled, and wherein as a result of differential thermal expansion of the fuel tube and the injector support during engine operation the fuel tube is relieved of compressive stress.

2. The fuel injector of claim 1, wherein the fuel tube is initially imparted with compressive stress and buckles during a braze cycle.

3. The fuel injector of claim 1, wherein the fuel tube has a slenderness ratio of 90 or greater.

4. The fuel injector of claim 1, wherein the injector support is made of stainless steel having a chemical composition by weight including approximately 16-26% chromium and 8-22% nickel, a maximum of 0.25% carbon, a maximum of 2% manganese, a maximum of 0.045% phosphorus, a maximum of 0.03% sulfur, a maximum of 1.5% silicon, and a maximum of 4% molybdenum.

5. The fuel injector of claim 4, wherein the fuel tube is made of a material having a chemical composition by weight including 3.15-4.15% niobium plus tantalum, 8-10% molybdenum, 20-23% chromium, a maximum of 5% iron, and a minimum of 58% nickel.

6. The fuel injector of claim 4, wherein the fuel tube is made of a material having a chemical composition by weight including approximately 22% chromium, 18% iron, 9% molybdenum, 1.5% cobalt, 0.6% tungsten, and 0.1% carbon, a maximum of 1% manganese, a maximum of 1% silicone, a maximum of 0.008% boron, and a remaining balance of approximately 47% nickel.

7. The fuel injector of claim 4, wherein the fuel tube is made of stainless steel having a chemical composition by weight including approximately 11.5-18% chromium, a maximum of 1.2% carbon, a maximum of 1.25% manganese, a maximum of 0.06% phosphorus, a maximum of 0.03% sulfur, a maximum of 0.06% nitrogen, a maximum of 1% silicone, a maximum of 0.55% nickel, and a maximum of 0.75% molybdenum.

8. The fuel injector of claim 1, further comprising multiple fuel tubes extending from the inlet fitting through the internal bore of the injector support to the outlet fitting.

9. The fuel injector of claim 1, wherein a first end of the fuel tube is fixed to the inlet fitting.

10. A fuel injector for a gas turbine engine, the fuel injector comprising:

an inlet fitting for receiving fuel;

an outlet fitting for delivering fuel through a nozzle to a combustor of the gas turbine engine;

an injector support extending between the inlet fitting and the outlet fitting having an internal bore therethrough; and a first fuel tube positioned in the inlet fitting and extending through the internal bore of the injector support to the outlet fitting, wherein the injector support has a greater coefficient of thermal expansion than the first fuel tube, and wherein the first fuel tube is fixed to the outlet fitting.

11. The fuel injector of claim 10, wherein the first fuel tube has a slenderness ratio of 90 or greater.

12. The fuel injector of claim 10, further comprising a second fuel tube extending parallel to the first fuel tube and positioned adjacent to the first fuel tube, wherein the injector support has a greater coefficient of thermal expansion than the second fuel tube, and wherein the second fuel tube is fixed to the outlet fitting.

13. The fuel injector of claim 10, wherein each of the first and second fuel tubes has a slenderness ratio of 90 or greater.

14. The fuel injector of claim 10, wherein the first fuel tube has a thermal expansion coefficient of approximately $16.38\times10^{-6}$ cm/cm ° C. ($9.1\times10^{-6}$ in./in.° F.) and the injector support has a coefficient of thermal expansion of approximately $19.98\times10^{-6}$ cm/cm ° C. ($11.1\times10^{-6}$ in./in.° F.).

* * * * *